US010477906B2

(12) United States Patent
Mangnall-Schwarz

(10) Patent No.: US 10,477,906 B2
(45) Date of Patent: Nov. 19, 2019

(54) WINGED CAPE FOR CHILDREN'S PLAY

(71) Applicant: Christine L. Mangnall-Schwarz, Henderson, NV (US)

(72) Inventor: Christine L. Mangnall-Schwarz, Henderson, NV (US)

( * ) Notice: Subject to any disclaimer, the term of this patent is extended or adjusted under 35 U.S.C. 154(b) by 144 days.

(21) Appl. No.: 15/689,881

(22) Filed: Aug. 29, 2017

(65) Prior Publication Data

US 2019/0021408 A1 Jan. 24, 2019

Related U.S. Application Data

(63) Continuation-in-part of application No. 29/583,755, filed on Nov. 8, 2016, now Pat. No. Des. 811,695.

(60) Provisional application No. 62/412,202, filed on Oct. 24, 2016.

(51) Int. Cl.

| | |
|---|---|
| ***A41D 3/08*** | (2006.01) |
| ***A41D 27/10*** | (2006.01) |
| ***A63J 7/00*** | (2006.01) |
| *A41D 3/00* | (2006.01) |

(52) U.S. Cl.

CPC ..... *A41D 3/08* (2013.01); *A41D 27/10* (2013.01); *A63J 7/00* (2013.01)

(58) Field of Classification Search

CPC ..... A41D 15/04; A41D 3/08; A41D 27/10; A41D 27/20; A41D 7/008; A41D 2200/20; A41D 27/08; A41D 11/00; A41D 1/00; A41D 23/00; A41D 15/00; A41D 7/006; A41D 19/01; A41D 27/204; A41D 27/24; A41D 3/00; A41D 13/0015; A41D 13/04; A41D 13/085; A47K 10/02; A47G 9/064; A47G 9/066; A63B 2208/03; A63H 33/22; A63H 33/00; A63J 7/005; A63C 17/267

See application file for complete search history.

(56) References Cited

U.S. PATENT DOCUMENTS

| | | | | | |
|---|---|---|---|---|---|
| D6,632 | S | * | 5/1873 | Landenberger, Jr. | D2/823 |
| D7,831 | S | * | 11/1874 | Landenberger | D2/823 |
| 197,346 | A | * | 11/1877 | Denneler | A41D 3/08 2/88 |
| 518,347 | A | | 4/1894 | Fuller | |

(Continued)

OTHER PUBLICATIONS

"https://www.lilblueboo.com/2014/10/how-to-make-butterfly-wings-from-t-shirts.html"; ; Oct. 15, 2014; accessed 2019; whole document. (Year: 2014).*

*Primary Examiner* — Robert H Muromoto, Jr.
(74) *Attorney, Agent, or Firm* — Quickpatents, LLC; Kevin Prince

(57) ABSTRACT

A winged cape for wearing by a person includes a flexible inner web and a flexible outer web, each fixed together with a threaded stitch at a common outline. Each web has a top edge and at least one side edge. Four arm slots are formed through the inner web to define a pair of sleeves that are generally orthogonal to a longitudinal axis of each web. Preferably two or more opposing elastic finger rings are each fixed with the at least one side edge of the inner web on opposing sides of the longitudinal axis of the inner web and proximate to a longitudinal axis of the sleeves. With each arm of the person positioned through one of the sleeves and a finger of each hand of the person inserted through one of the finger rings, the webs form a winged cape worn by the person.

13 Claims, 3 Drawing Sheets

(56) References Cited

U.S. PATENT DOCUMENTS 766,613 A * 8/1904 Greene ..... A41D 3/08 2/88
D45,010 S * 12/1913 Lanier ..... D2/739
D59,555 S * 11/1921 Ladd ..... 2/46
1,916,068 A * 6/1933 Nyhagen ..... A41D 7/008 2/69
D115,064 S * 5/1939 Fadie ..... D2/823
2,282,545 A * 5/1942 Rosenstein ..... A41D 27/20 2/247
D135,086 S * 2/1943 Raymundo ..... D2/853
D175,789 S * 10/1955 Massey ..... D2/853
2,810,576 A 10/1957 Massey
2,959,789 A * 11/1960 Mills ..... A41D 15/04 2/108
3,013,797 A 12/1961 Schwartz
D193,497 S * 9/1962 Kelley ..... D2/741
D193,498 S * 9/1962 Kelley ..... D2/741
4,263,678 A * 4/1981 Off ..... A41D 27/20 2/247
4,321,710 A * 3/1982 Off ..... A41D 27/20 2/247
4,349,920 A * 9/1982 Off ..... A41D 27/204 2/247
4,961,235 A * 10/1990 Williger ..... A41B 11/006 2/239
5,027,729 A * 7/1991 Airaksinen ..... A41D 27/204 112/475.06
D351,493 S * 10/1994 DeCinque ..... D2/741
D422,397 S * 4/2000 Cohen ..... D2/858
D431,050 S 9/2000 Collins
D433,210 S * 11/2000 Allison ..... D2/741
6,253,381 B1 7/2001 Kelley
D458,435 S * 6/2002 Rogone ..... D2/823
6,401,249 B2 * 6/2002 Haar ..... A41D 11/00 2/69
6,536,049 B2 * 3/2003 Jastrab ..... A41D 1/00 2/69.5
D494,743 S 8/2004 Bourget
6,922,848 B1 8/2005 Stanley
6,966,069 B2 * 11/2005 Booth ..... A47G 9/066 2/48
D518,120 S 3/2006 James
7,037,163 B2 * 5/2006 Beard ..... A63H 33/00 2/88
D527,171 S * 8/2006 Frederick ..... D2/741
D527,867 S * 9/2006 Chase ..... D2/823
D542,007 S * 5/2007 Huang ..... D2/728
7,380,285 B1 * 6/2008 Moreno ..... A41D 1/00 2/244
D578,278 S * 10/2008 Song ..... D2/823
D607,183 S * 1/2010 Stumpfl ..... D2/858
D618,433 S * 6/2010 Gray ..... D2/717
D619,333 S * 7/2010 Stowell ..... D2/823
D626,724 S * 11/2010 Duran, Jr. ..... D2/741
D634,899 S * 3/2011 Myers ..... D29/120.1
D634,917 S * 3/2011 Boehm ..... D2/823
7,992,220 B1 * 8/2011 McGoldrick ..... A41D 13/085 2/160
8,087,969 B2 * 1/2012 Sun ..... A63J 7/005 446/26
8,191,172 B2 * 6/2012 Polanish ..... A41D 13/0015 2/244
8,196,684 B2 * 6/2012 Caiozza ..... B64D 17/00 180/2.2
D665,972 S * 8/2012 Monteparo ..... D2/741
D665,973 S * 8/2012 Monteparo ..... D2/741
D665,974 S * 8/2012 Monteparo ..... D2/741
D665,975 S * 8/2012 Monteparo ..... D2/741
D679,484 S * 4/2013 Brown ..... D2/823
8,413,614 B2 * 4/2013 Kosanke ..... A01K 13/006 119/853
8,468,612 B1 * 6/2013 Galloway ..... A41D 23/00 2/207
8,800,062 B1 * 8/2014 Kunian ..... A41D 15/00 2/207
D722,234 S * 2/2015 BenDavid ..... D3/223
D730,589 S * 5/2015 Kosanke ..... D30/144
D730,590 S * 5/2015 Kosanke ..... D30/144
RE45,586 E * 6/2015 Kosanke ..... A01K 45/00
D732,248 S * 6/2015 Kosanke ..... D30/144
D735,446 S * 8/2015 Daws ..... D2/823
9,095,240 B2 * 8/2015 Bowen ..... A47K 10/02
D740,376 S 10/2015 Rehkemper
D747,049 S * 1/2016 Kosanke ..... D30/144
D747,848 S * 1/2016 Sanders ..... D2/823
D750,849 S * 3/2016 Kosanke ..... D30/144
D758,693 S 6/2016 Berry
D759,945 S * 6/2016 Brazill ..... D2/853
D763,728 S * 8/2016 Hung ..... D11/125
D764,761 S * 8/2016 Pavalon ..... D2/826
9,439,463 B1 9/2016 Spears
9,440,160 B1 * 9/2016 Isra-El ..... A63H 37/00
D768,960 S 10/2016 King
D792,679 S * 7/2017 Gamble ..... D2/826
D801,004 S * 10/2017 Perez ..... D2/825
D801,005 S * 10/2017 Perez ..... D2/825
9,775,387 B2 * 10/2017 Parr ..... A41D 3/08
D811,695 S * 3/2018 Mangnall-Schwarz ..... D2/823
10,045,575 B2 * 8/2018 Whyte ..... A41D 27/10
10,046,226 B2 * 8/2018 Pitlyk ..... A63B 71/06
10,117,471 B2 * 11/2018 Nam ..... A41D 27/08
D842,588 S * 3/2019 Mangnall-Schwarz ..... D2/741
2001/0054192 A1 12/2001 Haar
2002/0073476 A1 * 6/2002 Jastrab ..... A41D 1/00 2/88
2002/0188999 A1 12/2002 Haar
2009/0298378 A1 * 12/2009 Segal ..... A63J 7/005 446/26
2012/0060254 A1 * 3/2012 Blade ..... A41D 15/04 2/69
2013/0239290 A1 * 9/2013 Rossi ..... A41D 7/008 2/84
2014/0157480 A1 * 6/2014 Czarnik ..... A41D 15/04 2/69
2014/0165254 A1 * 6/2014 Bowen ..... A41D 7/008 2/69
2015/0189924 A1 7/2015 Desbrow
2015/0359271 A1 12/2015 Czamik

* cited by examiner

WINGED CAPE FOR CHILDREN'S PLAY

CROSS-REFERENCE TO RELATED APPLICATIONS

This application claims the benefit of U.S. Provisional Patent Application 62/412,202, filed on Dec. 24, 2016, and incorporated herein by reference. This application is also a continuation-in-part of US Design Patent application 29/583,755, filed on Nov. 8, 2016, and incorporated herein by reference.

STATEMENT REGARDING FEDERALLY SPONSORED RESEARCH AND DEVELOPMENT

Not Applicable.

FIELD OF THE INVENTION

This invention relates to costumes, and more particularly to a winged cape.

DISCUSSION OF RELATED ART

Children's costumes such as wearable wings and capes often have items that can be choking hazards, such as ties or bands worn that are fixed around the neck. During play, if such a cape were to snag on an object, the tie or band around the child's neck may cause serious injury to the child. For example, the cape toy of U.S. patent application Ser. No. 09/841,814 to Haar et al. shows a neckpiece configured for fixing around a child's neck.

Other wing-type costumes, such as those disclosed in US Design Patent D351,493 to DeCinque on Oct. 18, 1994, teach a winged costume device that does not cover a substantial portion of the body, and as such cannot easily be used to keep a person warm during play.

Therefore, there is a need for a wing-type costume that is not fastened around the neck, presenting a choking hazard. Such a needed invention would further be adapted to keep the user warm if desired during use. The needed costume would be made in a variety of shapes and sizes to allow for a variety of personal tastes in color and design. The present invention accomplishes these objectives.

SUMMARY OF THE INVENTION

The present device is a winged cape for wearing by a person. The person may be a child, a teen or an adult, the cape being suitable for keeping warm as well as for pretend play as a winged creature, for example.

A flexible inner web and a flexible outer web are each fixed together with a threaded stitch at a common outline thereof. Each web is preferably a soft fabric material, but may also be a vinyl sheet, paper sheet, or other flexible web material. Each web has a top edge and at least one side edge.

Four arm slots are formed through the inner web to define a pair of sleeves that are generally orthogonal to a longitudinal axis of each web. The sleeves are preferably generally coaxially aligned and integrally formed with the inner web. In some embodiments each sleeve is proximate to and generally parallel with the top edge of the webs. Each arm slot may further be hemmed with a buttonhole stitch therearound.

Preferably two or more opposing elastic finger rings are each fixed with the at least one side edge of the inner web on opposing sides of the longitudinal axis of the inner web and proximate to a longitudinal axis of the sleeves.

In use, with embodiments that include the sleeves, with each arm of the person positioned through one of the sleeves between the sleeve and the outer web, the longitudinal axis of the webs are parallel with and aligned with the person's torso. In embodiments having the finger rings, a finger of each hand of the person may be inserted through one of the finger rings to retain the side edges of the webs with the person's fingers. The webs form a winged cape worn by the person.

The present invention is a wing-type costume that is not fastened around the neck, but rather around the arms or fingers, thereby reducing the chance of choking during use. The present invention is adapted to keep the user warm during use, and can be made in a variety of shapes and sizes to allow for a variety of personal tastes in color and design. Other features and advantages of the present invention will become apparent from the following more detailed description, taken in conjunction with the accompanying drawings, which illustrate, by way of example, the principles of the invention.

DETAILED DESCRIPTION OF THE PREFERRED EMBODIMENT

Illustrative embodiments of the invention are described below. The following explanation provides specific details for a thorough understanding of and enabling description for these embodiments. One skilled in the art will understand that the invention may be practiced without such details. In other instances, well-known structures and functions have not been shown or described in detail to avoid unnecessarily obscuring the description of the embodiments.

Unless the context clearly requires otherwise, throughout the description and the claims, the words "comprise," "comprising," and the like are to be construed in an inclusive sense as opposed to an exclusive or exhaustive sense; that is to say, in the sense of "including, but not limited to." Words using the singular or plural number also include the plural or singular number respectively. Additionally, the words "herein," "above," "below" and words of similar import, when used in this application, shall refer to this application as a whole and not to any particular portions of this application. When the claims use the word "or" in reference to a list of two or more items, that word covers all of the following interpretations of the word: any of the items in the list, all of the items in the list and any combination of the items in the list. When the word "each" is used to refer to an element that was previously introduced as being at least one in number, the word "each" does not necessarily imply a plurality of the elements, but can also mean a singular element.

Figure 1:
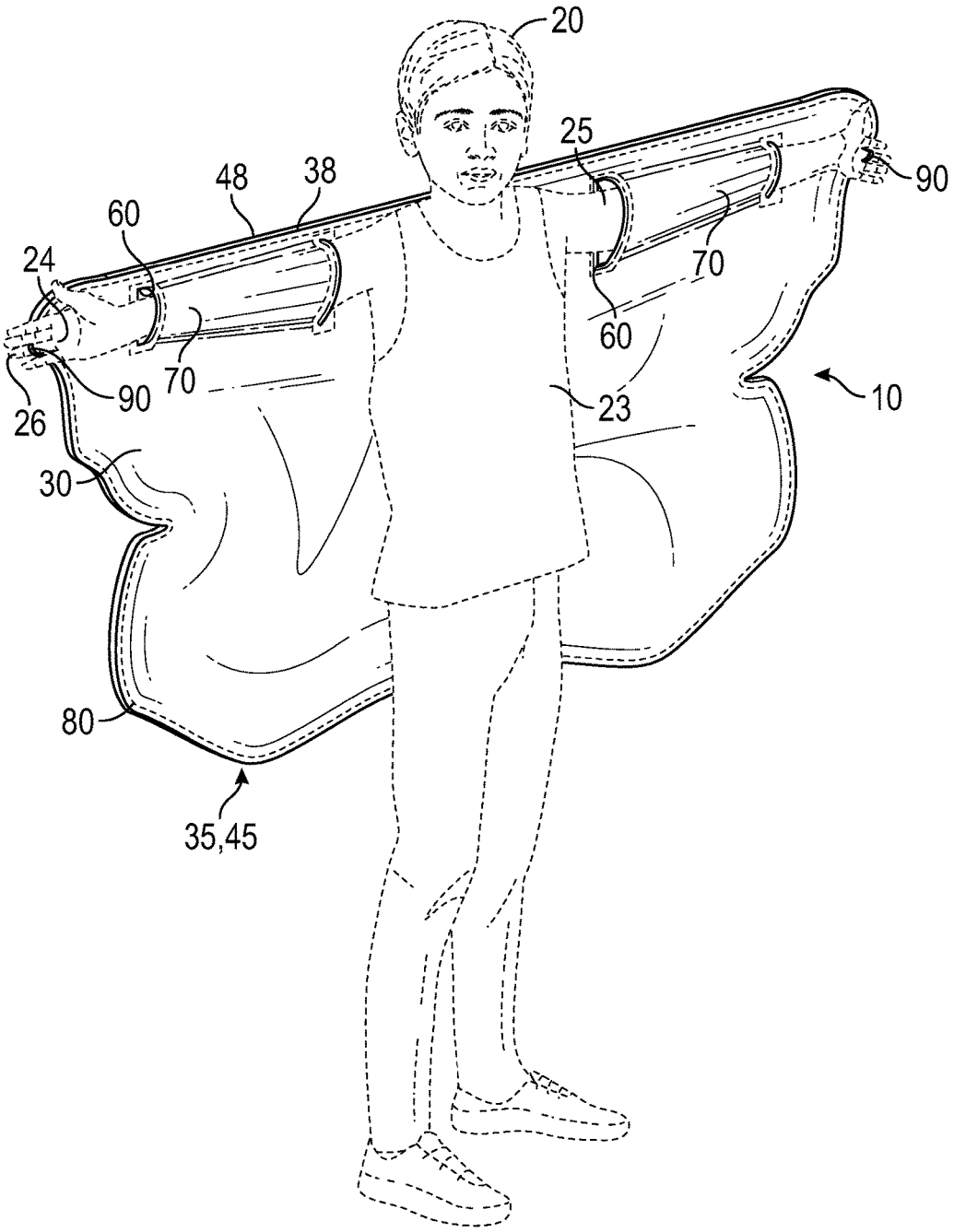
FIG. 1 is a perspective view of the invention, illustrated as used by a person.
Figure 2:
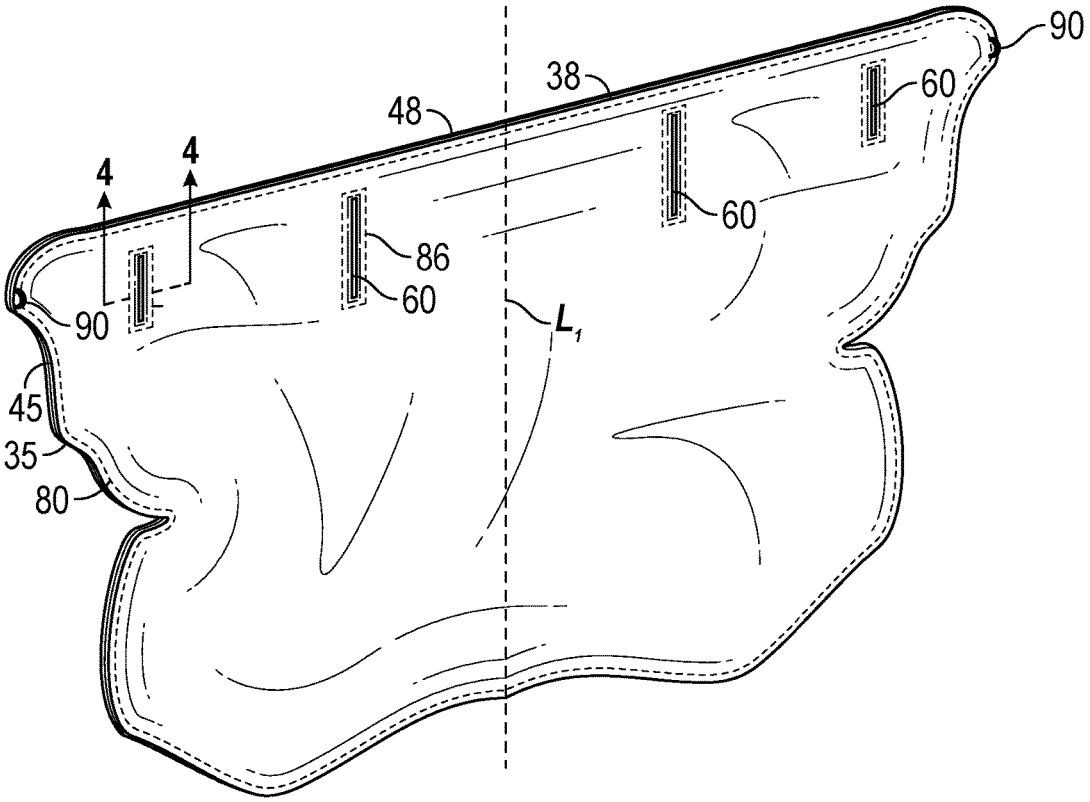
FIG. 2 is a perspective view of FIG. 1 with the person omitted for clarity of illustration.

FIGS. 1 and 2 illustrate a winged cape 10 for wearing by a person 20. The person 20 may be a child, a teen or an adult, the cape being suitable for keeping warm as well as for pretend play as a winged creature.

Figure 3:
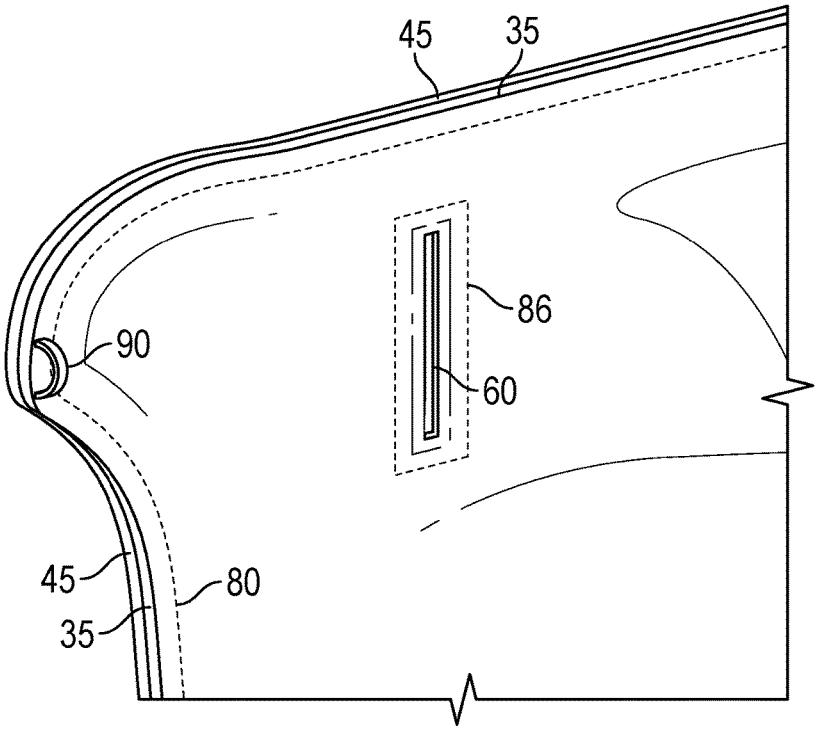
FIG. 3 is an enlarged perspective view of the invention, showing an inner web and an outer web sewn together at a common peripheral edge.
Figure 5:
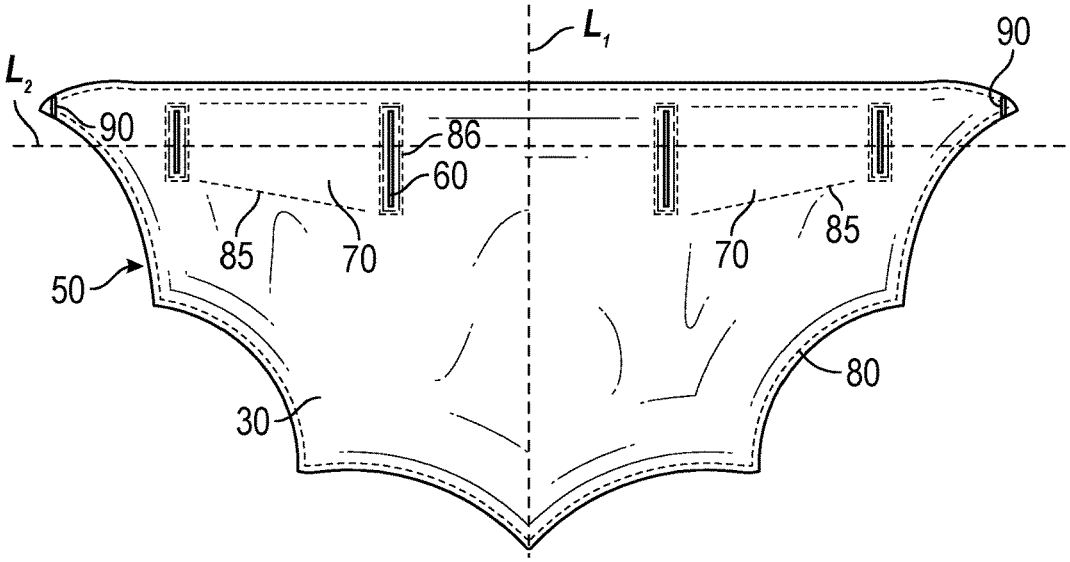
FIG. 5 is a front elevational view of an alternate embodiment of the invention.
Figure 6:
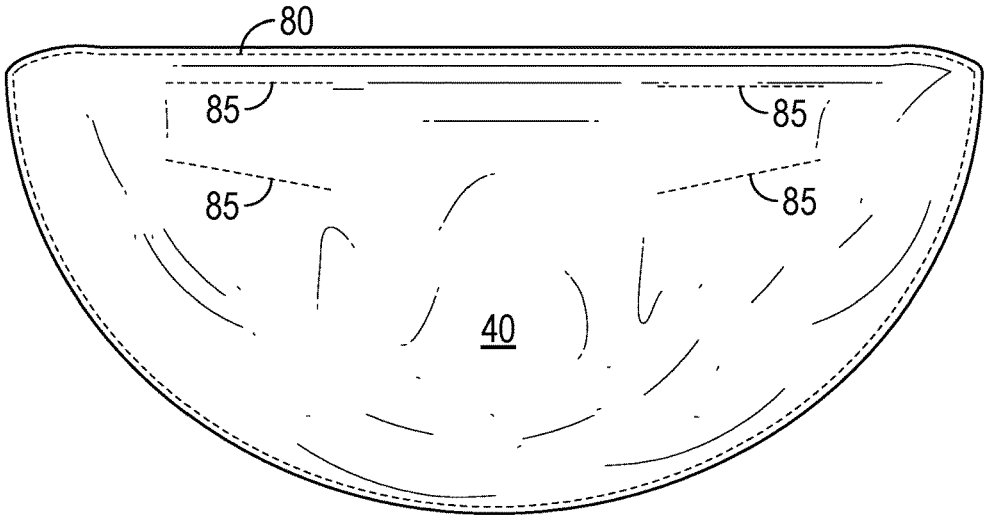
FIG. 6 is a rear elevational view of another alternate embodiment of the invention.

A flexible inner web 30 and a flexible outer web 40 are each fixed together at a common outline 50 thereof (FIG. 3). Each web 30 is preferably a soft fabric material, such as polyester fleece fabric, but may also be a vinyl sheet, paper sheet, or other flexible web material. Each web 30,40 has a top edge 38,48 and at least one side edge 35,45. Each web 30,40 is mutually fixed together preferably with a threaded sewn stitch 80, but may also be fixed together with ultrasonic bonding, adhesive, or the like. Each web 30,40 may optionally be further mutually sewn together along at least two additional stitches 85 (FIGS. 5 and 6) outside of the sleeves 70 defined between arm slots 60 in the inner web 30. The visible sides of each web 30,40 are preferably printed with a bright pattern representing butterfly or bird wings (not shown), insect markings, or the like.

Figure 4:
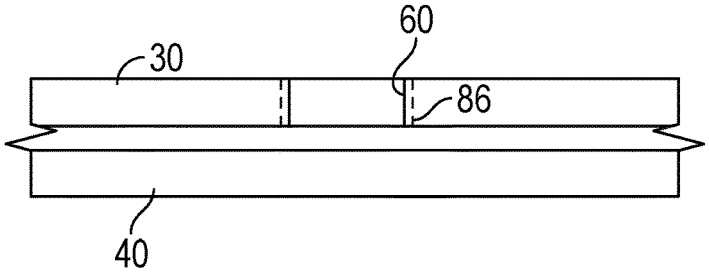
FIG. 4 is a cross-sectional view of the invention, taken generally along lines 4-4 of FIG. 2.

Preferably four arm slots 60 (FIGS. 1-5) are formed through the inner web 30 to define a pair of sleeves 70 that are generally orthogonal to a longitudinal axis $L_1$ of each web 30,40. The sleeves 70 are preferably generally coaxially aligned and integrally formed with the inner web 30. In some embodiments each sleeve 70 is proximate to and generally parallel with the top edge 38,48 of the webs 30,40. Each arm slot 60 may further be hemmed with a buttonhole stitch 86 (FIGS. 3 and 4) therearound.

Preferably two or more opposing elastic finger rings 90 are each fixed with the at least one side edge 35 of the inner web 30 on opposing sides of the longitudinal axis $L_1$ of the inner web 30 and proximate to a longitudinal axis $L_2$ of the sleeves 70.

In use, with embodiments that include the sleeves 70, with each arm 25 of the person positioned through one of the sleeves 70 between the sleeve 70 and the outer web 40, the longitudinal axis $L_1$ of the webs 30,40 are parallel with and aligned with the person's torso 23. In embodiments having the finger rings 90, a finger 26 of each hand 24 of the person 20 may be inserted through one of the finger rings 90 to retain the side edges 35,45 of the webs 30,40 with the person's fingers 26. The webs 30,40 form a winged cape worn by the person 20.

While a particular form of the invention has been illustrated and described, it will be apparent that various modifications can be made without departing from the spirit and scope of the invention. For example, particular shapes of the webs 30,40 may be utilized, such as those that look like butterfly wings (FIG. 1), bat wings (FIG. 5), beetle wings (FIG. 6), or other shapes as desired such as airplane wings (not shown). Accordingly, it is not intended that the invention be limited, except as by the appended claims.

Particular terminology used when describing certain features or aspects of the invention should not be taken to imply that the terminology is being redefined herein to be restricted to any specific characteristics, features, or aspects of the invention with which that terminology is associated. In general, the terms used in the following claims should not be construed to limit the invention to the specific embodiments disclosed in the specification, unless the above Detailed Description section explicitly defines such terms. Accordingly, the actual scope of the invention encompasses not only the disclosed embodiments, but also all equivalent ways of practicing or implementing the invention.

The above detailed description of the embodiments of the invention is not intended to be exhaustive or to limit the invention to the precise form disclosed above or to the particular field of usage mentioned in this disclosure. While specific embodiments of, and examples for, the invention are described above for illustrative purposes, various equivalent modifications are possible within the scope of the invention, as those skilled in the relevant art will recognize. Also, the teachings of the invention provided herein can be applied to other systems, not necessarily the system described above. The elements and acts of the various embodiments described above can be combined to provide further embodiments.

All of the above patents and applications and other references, including any that may be listed in accompanying filing papers, are incorporated herein by reference. Aspects of the invention can be modified, if necessary, to employ the systems, functions, and concepts of the various references described above to provide yet further embodiments of the invention.

Changes can be made to the invention in light of the above "Detailed Description." While the above description details certain embodiments of the invention and describes the best mode contemplated, no matter how detailed the above appears in text, the invention can be practiced in many ways. Therefore, implementation details may vary considerably while still being encompassed by the invention disclosed herein. As noted above, particular terminology used when describing certain features or aspects of the invention should not be taken to imply that the terminology is being redefined herein to be restricted to any specific characteristics, features, or aspects of the invention with which that terminology is associated.

While certain aspects of the invention are presented below in certain claim forms, the inventor contemplates the various aspects of the invention in any number of claim forms. Accordingly, the inventor reserves the right to add additional claims after filing the application to pursue such additional claim forms for other aspects of the invention.

What is claimed is:

1. A winged cape for wearing by a person, comprising:

a flexible inner web and a flexible outer web, each web sharing a common outline representing a pair of wings, each web mutually fixed at least along their common outline, each web having a top edge and at least one side edge;

at least four parallel arm slots formed through the inner web to define sleeves generally orthogonal to a longitudinal axis of each web, the sleeves mutually coaxially aligned and integrally formed with the inner web;

whereby when worn each arm of the person positioned through one of the arm sleeves between the arm sleeve and the outer web, the longitudinal axes of the webs are parallel with and aligned with the person's torso, the webs forming the winged cape when worn by the person, wherein each web is further directly mutually sewn together along at least two additional stitches outside of the sleeves defined between arm slots in the inner web.

2. The winged cape of claim 1 wherein each web is mutually fixed at least along their common outline with a sewn stitch.

3. The winged cape of claim 1 wherein each sleeve is proximate to and generally parallel with the top edge of the webs.

4. The winged cape of claim 1 further including two opposing elastic finger rings, each fixed with the at least one side edge of the inner web on opposing sides of the longitudinal axes of the webs and proximate to a longitudinal axis of the sleeves, whereby when worn by the person, a finger of each hand of the person may be inserted through one of the finger rings to retain the side edges of the webs with the person's fingers.

5. The winged cape of claim 3 further including two opposing elastic finger rings, each fixed with the at least one side edge of the inner web on opposing sides of the longitudinal axes of the webs and proximate to a longitudinal axis of the sleeves, whereby when worn by the person, a finger of each hand of the person may be inserted through one of the finger ring to retain the side edges of the webs with the person's fingers.

6. The winged cape of claim 1 wherein each arm slot is hemmed with a buttonhole stitch therearound.

7. A winged cape for wearing by a person, comprising:

a flexible inner web and a flexible outer web, each web sharing a common outline representing a pair of wings, each web mutually fixed at least along their common outline with a sewn stitch, each web having a top edge and at least one side edge;

at least four parallel arm slots formed through the inner web to define sleeves generally orthogonal to a longitudinal axis of each web, the sleeves mutually coaxially aligned and integrally formed with the inner web, each sleeve being proximate to and generally parallel with the top edge of the webs;

whereby when worn each arm of the person positioned between one of the arm sleeves and the outer web, the longitudinal axes of the webs are parallel with and aligned with the person's torso, the webs forming a winged cape when worn by the person, wherein each web is further directly mutually sewn together along at least two additional stitches outside of the sleeves defined between arm slots in the inner web.

8. The winged cape of claim 7 further including two opposing elastic finger rings, each fixed with the at least one side edge of the inner web on opposing sides of the longitudinal axes of the webs and proximate to a longitudinal axis of the sleeves, whereby when worn by the person, a finger of each hand of the person may be inserted through one of the finger ring to retain the side edges of the webs with the person's fingers.

9. The winged cape of claim 7 wherein each arm slot is hemmed with a buttonhole stitch therearound.

10. A winged cape for wearing by a person, comprising:

a flexible inner web and a flexible outer web, each web sharing a common outline representing a pair of wings, each web mutually fixed at least along their common outline, each web having a top edge and at least one side edge;

two opposing elastic finger rings each fixed with the at least one side edge of the inner web on opposing sides of the longitudinal axes of the webs;

at least four parallel arm slots formed through the inner web to define sleeves generally orthogonal to a longitudinal axis of each web, the sleeves mutually coaxially aligned and integrally formed with the inner web;

whereby when worn by the person, a finger of each hand of the person may be inserted through one of the finger ring to retain the side edges of the webs with the person's fingers, the webs forming a winged cape when worn by the person, wherein each web is further directly mutually sewn together along at least two additional stitches outside of the sleeves defined between arm slots in the inner web.

11. The winged cape of claim 10 wherein each web is mutually fixed at least along their common outline with a sewn stitch.

12. The winged cape of claim 10 wherein each sleeve is proximate to and generally parallel with the top edge of the webs.

13. The winged cape of claim 10 wherein, when worn each arm of the person positioned between one of the arm sleeves and the outer web, the longitudinal axes of the webs are parallel with and aligned with the person's torso, the webs forming a winged cape when worn by the person.

* * * * *